US007729502B2

(12) United States Patent
Beck

(10) Patent No.: US 7,729,502 B2
(45) Date of Patent: Jun. 1, 2010

(54) HEARING AID TUBE MOLDING HEATER

(76) Inventor: Charles Beck, 258 Naples St., Chula Vista, CA (US) 91911

( * ) Notice: Subject to any disclaimer, the term of this patent is extended or adjusted under 35 U.S.C. 154(b) by 43 days.

(21) Appl. No.: 12/246,773

(22) Filed: Oct. 7, 2008

(65) Prior Publication Data

US 2010/0086160 A1 Apr. 8, 2010

(51) Int. Cl.
*H04R 25/00* (2006.01)

(52) U.S. Cl. ..... 381/330; 381/312; 381/322

(58) Field of Classification Search ..... 381/330
See application file for complete search history.

(56) References Cited

U.S. PATENT DOCUMENTS 7,027,608 B2 * 4/2006 Fretz et al. ..... 381/330
2006/0023909 A1 * 2/2006 Grafenberg ..... 381/330
2008/0111283 A1 * 5/2008 Espersen et al. ..... 264/401
2009/0121386 A1 * 5/2009 Ipsen et al. ..... 264/263

* cited by examiner

*Primary Examiner*—Curtis Kuntz
*Assistant Examiner*—Matthew Eason
(74) *Attorney, Agent, or Firm*—Steven W. Webb

(57) ABSTRACT

An improved device for heating hearing aid microtubes is presented, the invention comprised of inexpensive electrical parts and a simple plastic base. The device possesses a heater flue that is shaped to concentrate the heat from the heating element along a short length of the hearing aid audio tube to be formed as well as a metal reflector to increase the efficiency of the heater element. The device has nonskid feet and air holes to improve the cooling of the device.

4 Claims, 2 Drawing Sheets

HEARING AID TUBE MOLDING HEATER

FIELD OF THE INVENTION

This invention relates to the field of hearing aid tube molders and bending implements.

BACKGROUND OF THE INVENTION

Hearing aids that are in the behind-the-ear style require microtubes to carry the received and amplified sound to the sound transducer placed in the ear canal. The sound receiving and amplifying equipment is placed behind the ear to keep it hidden as much as possible; the sound tube is shaped to bend around the upper part of the external ear to keep it out of site.

Microtubes are made of soft plastic that can be shaped easily to fit around the external ear structure. The plastic is firm and holds its shape at room temperature, but will bend easily when heated. At the time when the hearing aid is fitted to a customer by an audiologist or other hearing aid specialist, the primary means for shaping such microtubes is applying a measured amount of heat to the tubes and bending them by hand.

There currently exists no means of applying such localized heat to a microtube for audiologist office use. The present invention is a specialized heater with a small-bore flume that addresses this function. The heater enables the hearing aid fitter to place the microtube close enough to an open heat source so that the tube bends without melting the plastic of the tube.

There are several designs for such heaters, and they all suffer from certain design limitations. The present invention is designed to address some of these limitations in an inexpensive stand-alone mechanism that is easy to use.

OBJECTS OF THE INVENTION

An object of the present invention is to produce a low-cost hearing aid audio tube heater.

Another object of the present invention is to produce a hearing aid audio tube heater that has improved heat concentration.

Another object of the present invention is to produce a hearing aid audio tube heater that has a self-cooling feature.

Another object of the present invention is to produce a hearing aid audio tube heater that has ant-sliding feet.

Another object of the present invention is to produce a hearing aid audio tube heater that has a heat reflecting element to further concentrate the heat from the element.

SUMMARY OF THE INVENTION

The present invention is a stand-alone device for applying heat to hearing aid audio tubes for the purpose of bending them, so as to improve the fit of the audio tubes to the external parts of the human ear. The device is a small rectangular box with a heating element standing on top of it, a series of commercial-off-the-shelf electric components inside the box to power the heating element, a characteristically shaped flue to permit hot air to rise from the flue in a manner best designed to warm a hearing aid audio tube, and a heat reflector to concentrate the output from the heating element.

The underside of the invention includes a removable plate with four air holes and nonskid foot pads. The air holes allow cool air to rise through the chassis of the device up into and out of the heating element flue.

BRIEF DESCRIPTION OF THE DRAWINGS

The features of this invention will be best understood from the accompanying drawings, taken in conjunction with the accompanying description.

DESCRIPTION OF THE PREFERRED EMBODIMENT

Figure 1:
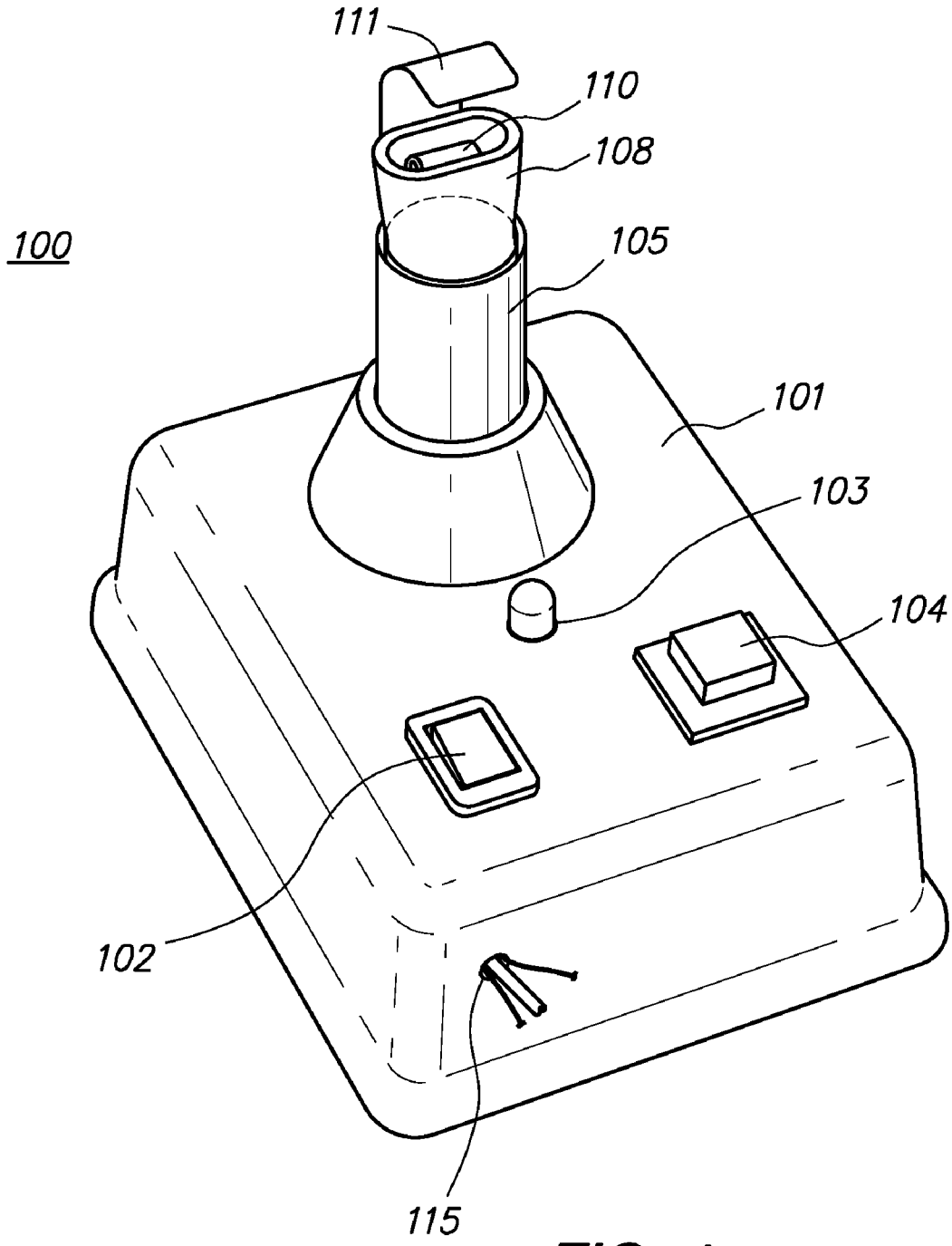
FIG. 1 is a perspective view of the invention.

The invention 100 can be seen best in FIG. 1. The invention 100 consists of a rectangular base 101 with a power switch 102, a heater-armed light 103, a heater switch 104, a flue 105, a flue opening 108, a heating element 110, and a heater reflector 111. An electrical cord (not shown) is attached to the electronics within the rectangular base 101 by means of a hole (not shown) through the side of the rectangular base 101. There is a microtube storage hole 115 in the rectangular base 101.

The heating element 110 is in the preferred embodiment 0.008" nichrome wire coated with a proprietary material that strengthens the heating element so it will not short-circuit. The heater reflector 111 in the preferred embodiment is chrome-plated metal.

Figure 2:
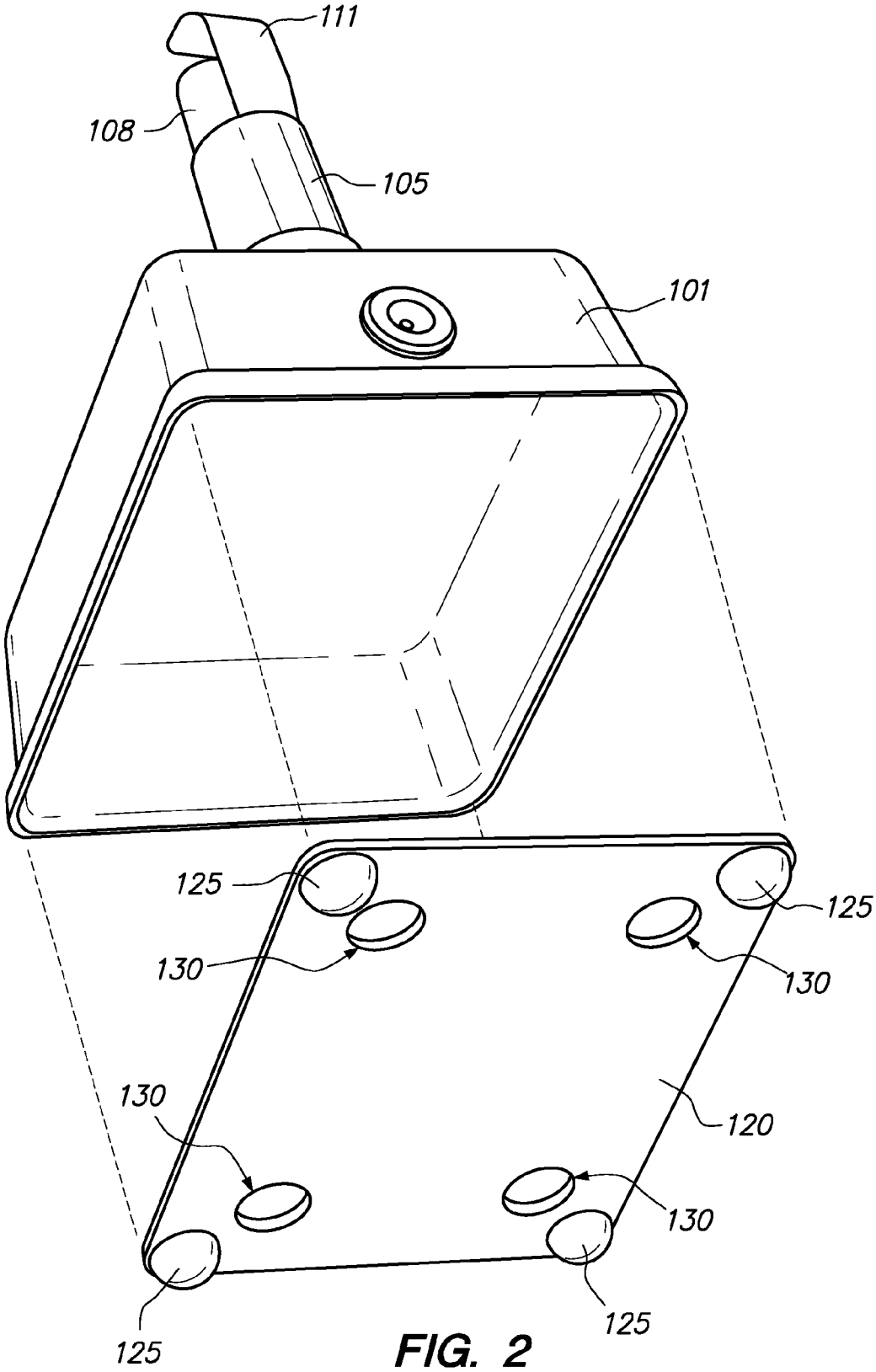
FIG. 2 is a exploded view of the underside of the invention

In FIG. 2, the detachable bottom plate 120 is shown exploded away from the underside of the rectangular base 101. The interior of the rectangular base 101 contains Commercial-Off-The-Shelf electric part s (not shown) that control and use the power coming in through the electrical cord. The electrical parts route electric power to the heating element 110, the heater switch 104 and also power the heater-armed light 103. The detachable bottom plate also possesses four anti-skid feet 125 that keep the invention from sliding over a table surface when in use and four air holes 130 that allow air to enter the rectangular base and cool the electrical parts, while exiting through the flue opening 108 and aiding in heating the hearing aid audio tube.

The heater reflector 111 is a shiny metal piece that is curved in a characteristic way to reflect the heat from the heating element back down towards the upper surface of any microtube that is inserted between the heater reflector 111 and the heating element 110. This permits more even heating of the microtube and reduces the need to rotate the microtube over the heating element 110.

The flue opening 108 is shaped in a manner that directs heat along a short length of the microtube when it is inserted under the heater reflector 111. This replaces and improves the circular-shaped opening of industry-standard microtube heaters.

The invention 100 is used by first turning on the device by pressing the power switch 102 and waiting for the heater-armed light 103 to light. Then a section of microtube to be shaped is selected, the heater switch 104 is pressed, and the microtube is held between the flue opening 108 and the heater reflector 111. The operator can position the microtube to soften a section of the microtube such that the microtube can be bent to the desired shape, returning the micro tube to the heat source as often as necessary.

Within the COTS electrical equipment carried inside the rectangular base 101, there is a timer circuit that cuts off power to the heating element 110 after a specified time delay. In the preferred embodiment, the time delay is 45 seconds. After the time delay has expired, the heater switch 104 has to be pressed again.

While the foregoing describes a preferred embodiment of the invention, variation on this design and equivalent methods may be resorted to in the scope and spirit of the claimed invention.

What is claimed is:

1. A hearing aid microtube heater, comprised of a rectangular base, and a heater assembly, the rectangular base comprised of a hollow rectangular chassis, the upper surface of the chassis possessing a power switch, a heater-armed light, a heater switch and the heater assembly, the heater assembly comprised of a flue, a flue opening, a heating element, and a heater reflector, the flue opening possessing a characteristic elongated shape, the heater reflector bent in a shape that accommodates the width of a hearing aid microtube, the hollow rectangular chassis also possessing an electrical cord opening through the side of the rectangular chassis and a detachable bottom plate, the hollow rectangular chassis also possessing in its interior commercial-off-the-shelf electrical parts that control power flow into the invention, power the heating element, control the power indicator light and respond to the power switch and heater-armed switch, and a heater element timer circuit, the underside of the detachable bottom plate possessing a plurality of air holes and a plurality of nonskid feet.

2. A hearing aid microtube heater as in claim 1, where the flue opening is made of clear glass.

3. A hearing aid microtube heater as in claim 1, where the heater element timer circuit has a time delay of 45 seconds.

4. A method of using the hearing aid microtube heater, as in claim 1, comprised of the steps of turning on the microtube heater by pressing the power switch, selecting a length of microtube to be bent, pressing the heater switch such that the heating element is turned on, waiting for the heater-armed light to light up, placing the length of microtube between the flue opening and the heater reflector, bending the length of micro tube to the desired shape.

* * * * *